US007981477B2

(12) United States Patent
Burdick

(10) Patent No.: US 7,981,477 B2
(45) Date of Patent: Jul. 19, 2011

(54) HYDROXYALKYLCELLULOSE AS ADDITIVE IN PIGMENTED METERING SIZE PRESS COATINGS

(75) Inventor: Charles L. Burdick, Landenberg, PA (US)

(73) Assignee: Hercules Incorporated, Wilmington, DE (US)

( * ) Notice: Subject to any disclaimer, the term of this patent is extended or adjusted under 35 U.S.C. 154(b) by 608 days.

(21) Appl. No.: 11/065,621

(22) Filed: Feb. 24, 2005

(65) Prior Publication Data

US 2005/0191425 A1 Sep. 1, 2005

(51) Int. Cl.
*B05D 1/00* (2006.01)

(52) U.S. Cl. ..... 427/359; 427/361; 427/364; 427/365; 427/391; 427/395

(58) Field of Classification Search ..... None
See application file for complete search history.

(56) References Cited

U.S. PATENT DOCUMENTS

| | | | | | |
|---|---|---|---|---|---|
| 3,288,630 | A * | 11/1966 | Plunguian | ..... | 427/339 |
| 4,228,277 | A * | 10/1980 | Landoll | ..... | 536/90 |
| 4,994,112 | A * | 2/1991 | Majewicz et al. | ..... | 106/172.1 |
| 5,320,897 | A * | 6/1994 | Kondo et al. | ..... | 428/32.36 |
| 5,425,806 | A * | 6/1995 | Doolan et al. | ..... | 106/203.1 |
| 5,643,631 | A * | 7/1997 | Donigian et al. | ..... | 427/218 |
| 6,123,760 | A * | 9/2000 | Varnell | ..... | 106/174.1 |
| 6,942,919 | B2 * | 9/2005 | Tokiyoshi et al. | ..... | 428/327 |
| 7,320,825 | B2 * | 1/2008 | Morabito | ..... | 428/402 |
| 2004/0045686 | A1 * | 3/2004 | Nisogi et al. | ..... | 162/135 |

FOREIGN PATENT DOCUMENTS

| | | | |
|---|---|---|---|
| EP | 0 651 093 | | 5/1995 |
| EP | 1 467 022 | | 10/2004 |
| WO | WO 03/060232 | * | 7/2003 |

OTHER PUBLICATIONS

Beeman et al, Tappi, 46(2), pp. 134-141, 1963.*
Burova, E. et al, "Use of modified h ydroxyethyIcellulose in coating suspensions", XP002364531 (abstract), Khim, Tekhnol. Bumagi No. 1:19-23,1973.

* cited by examiner

*Primary Examiner* — Erma Cameron
(74) *Attorney, Agent, or Firm* — Robert O'Flynn O'Brien; Joanne Mary Fobare Rossi

(57) ABSTRACT

Pigmented coated paper is prepared by adding a water-soluble hydroxyalkylcellulose (HAC) with an alkyl moiety of 1 to 4 carbons, or water soluble alkylhydroxyalkylcellulose (AHAC) with an alkyl hydrophobe of 1 to 24 carbons to a pigmented wet coating formulation in an amount equal to or greater than 0.15 parts HAC or AHAC based on pigment content of the coating and applying the pigmented wet coating formulation to a moving paper web via roller metering size press, wherein the use of HAC or AHAC in the pigmented coating significantly reduce misting of the coating during application as compared to the control condition with no HAC or AHAC added.

8 Claims, 1 Drawing Sheet

Metering Size Press Misting Panels with HEC-thickened Coating at Various Coater Speed Metering Size Press Misting Panels with HEC-thickened Coating at Various Coater Speed

Figure 2 – Prior Art

Metering Size Press Misting Panels with CMC Coating at Various Coater Speeds

HYDROXYALKYLCELLULOSE AS ADDITIVE IN PIGMENTED METERING SIZE PRESS COATINGS

FIELD OF THE INVENTION

The present invention relates to a process for preparing coated paper wherein the coating is applied by a roller or set of rollers as a film layer to a moving paper substrate. More specifically, this invention relates to the adding of a specific type of rheology modifier to a paper coating to enhance the film transfer process so as to effect improved coated paper properties.

BACKGROUND OF THE INVENTION

It is desired in various industries to use rheology modifiers to achieve thickening, flow control, water retention and other properties in aqueous systems. A number of rheology modifiers are commercially available, such as sodium carboxymethylcellulose (CMC), guar gum, sodium alginate, hydroxyethylcellulose (HEC), alkali-soluble lattices, starch or starch derivatives, and the like.

Coated paper manufacturers have traditionally used one or more of the above rheology modifiers as additives for paper coating compositions in order to attain key application properties. Paper coatings are typically composed of a pigment, such as kaolin clay and calcium carbonate, binders, such as starch and styrene butadiene latex, water, various specialty additives, and at least one of the above mentioned rheology modifiers It has been determined in prior industrial practice that the above rheology modifiers are often interchangeable when employed in the application of paper coating thickening, where the coating has been applied by traditional methods such as blade metering. For general use, CMC is established as one of the most prevalent rheology modifiers for traditional blade metered paper-coating application.

In recent years, a new method of applying aqueous pigment containing paper coatings onto the surface of paper has been devised that is known as "pigmented metering size press" or sometimes "film transfer coating". In this method of coating paper, a wet coating is first metered onto a roller that is typically composed of stainless steel or synthetic substrate. The wet coating film layer is then transferred by contact to a moving web of paper. Typically this operation is performed on both sides of the paper simultaneously.

Unfortunately, in the pigmented metering size press application of paper coating to a moving paper web, it is often observed that an aerosol mist of the wet paper coating is formed as the paper web leaves the nip of the adjacent rollers. It is, thus, generally known in the paper industry that "misting" of pigmented paper coatings is a severe problem that is often observed when these are applied by means of metering size press equipment. Misting refers to the tendency of pigmented coatings to form an aerosol on the exit side of the film press during application to the paper web. This problematic coating mist can deposit on surfaces in the mill, and is a severe cleanup problem, as well as depleting expensive coating in a wasteful manner. Because of the prevalence of this problem, the large-scale industrial use of pigmented metering size press has been slow to develop commercially. The producers wanting to use this technology has had to develop coating formulations that are very closely formulated with equipment operations that are strictly controlled in order to minimize the adverse misting effect. The use of most rheology modifiers in pigmented metering size press application is ineffective for reducing misting under many conditions.

Since, In the past, adjustments of equipment, processing conditions, and/or coating color formulations have been made in an attempt to improve runnability and reduce misting. Hence, a need exists in the paper industry to develop a pigmented metering size press coating process to minimize the above mentioned problems.

SUMMARY OF THE INVENTION

The present invention is directed to a process for preparing coated paper comprising a) adding a water-soluble hydroxyalkylcellulose (HAC) with an alkyl moiety of 1 to 4 carbons, or water soluble alkylhydroxyalkylcellulose (AHAC) with an alkyl hydrophobe of 1 to 24 carbons to a wet coating formulation in a n amount equal to or greater than 0.15 parts HAC or AHAC based on pigment content of the coating and b) applying the pigmented wet coating formulation to a moving paper web via roller metering (film transfer) size press, wherein the use of HAC or AHAC in the pigmented coating significantly reduce misting of the coating during application as compared to the control condition with no HAC or AHAC added.

Examples of the hydroxyalkylcellulose (HAC) are hydroxyethylcellulose (HEC) and hydroxybutylcellulose (or n-butylhydroxyethylcellulose)(BHEC). Examples of the alkylhydroxyalkylcellulose (AHAC) are methylhydroxyethylcellulose (MHEC), and ethylhydroxyethylcellulose (EHEC).

BRIEF DESCRIPTION OF DRAWINGS

In the accompanying drawings:

FIG. 2 is metering size press misting panels with CMC coating at various coater speeds.

DETAILED DESCRIPTION OF THE INVENTION

Figure 1:
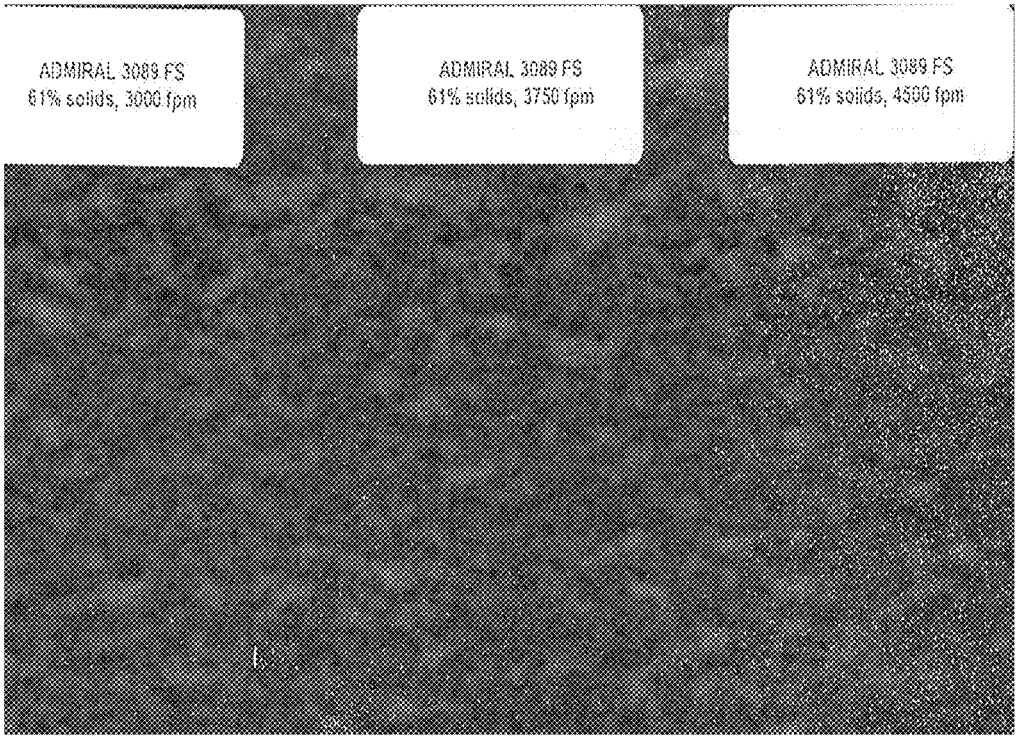
FIG. 1 is metering size press misting panels with HEC thickened coating at various coater speeds.
Figure 1:
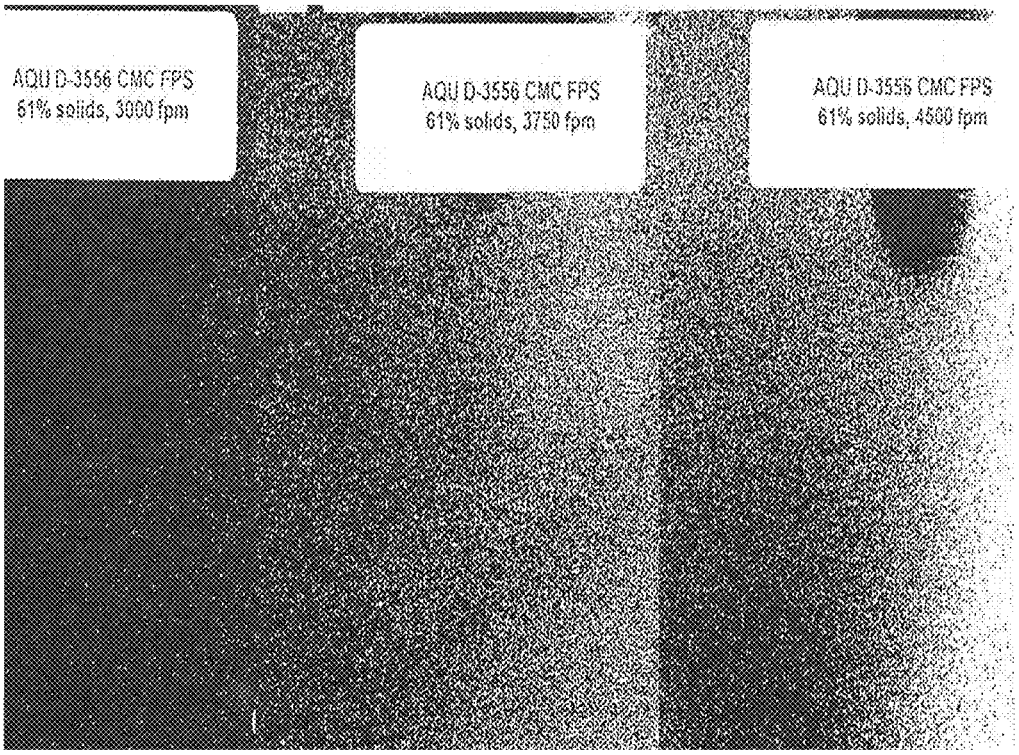

It has been unexpectedly found that the use of HAC and AHAC in the pigmented metering size press process reduces misting of a general paper coating recipe and indicates significant potential for commercial utility of this process. Thus, the combination of a specific rheology modifier with preexisting metering size press apparatus and coating formulations represent a significantly improved process for making coated paper.

This invention has advantages in preventing the misting that has been traditionally observed in the prior art pigmented metering size press operations. In contrast to the prior art metering size press process, the present invention has unexpectedly been found to produce a balance of additional performance properties, such as enhanced fiber coverage, opacity, and brightness that are significantly useful for the end product of the metering size press application.

The present invention represents a more detailed process of:

1 ) Preparing a coating mixture of water, standard paper coating pigments, binders, and at least one hydroxyalkylcellulose such as hydroxyethylcellulose, or derivative thereof;

2) Applying the coating by metering the coating layer onto a set of moving rollers;

3) Transferring the wet coating layer onto a paper web by passing the paper web between the rollers on which the wet paper coating was previously applied; and 4) Drying the wet coated paper to form a final dried coating layer. The runnability and paper optical properties are improved by this process as opposed to prior art processes that do not use HAC or derivatives thereof.

The cellulose ethers operable in the present invention include all water soluble nonionic derivatives of cellulose containing hydroxyethyl functionality and that express aqueous solution viscosities in excess of 100 centipoise at a concentration of 5% in water. The water-soluble polymer may also in addition to hydroxyethyl functionality also be derivatized with other substituents such as a methyl group, butyl group, or longer hydrophobes having up to 24 carbon atoms. In the case where any one of these types of water-soluble polymers are employed as a rheology modifier in a pigmented metering size press paper coatings they would be dosed into the coating at a level to attain a runnable coating viscosity typically of 100-4000 cps. The dosage of rheology modifier employed in practice is typically 0.2-0.8 parts of rheology modifier based upon 100 parts of pigment in the coating. It is reasonable to suggest that a range of 0.05 to 2 parts of the rheology modifier of the present invention could be effective for conveying desirable runnability features to pigmented metering size press coatings.

In accordance with the present invention, a typical coating formulation would contain about 100 parts pigment, about 10 to about 18 parts binder (i.e., starch and/or latex), about 20 to about 60 % solids. Preferably, the solids content can be 50 to 60%. The HAC or AHAC content in this composition is 0.2 to 0.8 part, which is included in the solids percentage. Examples of the binder that is used in this composition is starch and latex (which can be styrene or vinyl based). Examples of the pigment in this composition are calcium carbonate and kaolin clay.

The present invention is further illustrated in the following examples, wherein all parts or percentages mentioned are by weight unless otherwise indicated. These examples are given only by way of illustration and are not intended to limit the invention except as set forth in the claims.

THE EXAMPLE

In a series of pilot scale pigmented metering size press tests, paper coatings were prepared with identical pigments, binders, and other additives, at equal percent solids, then thickened to a constant viscosity target range by means of various rheology modifiers, including hydroxyethylcellulose and sodium carboxymethylcellulose of different molecular weights. These various coating samples were then, in turn, applied in successive tests to a paper substrate by means of a high-speed film press pilot apparatus. Variable speeds were used to surface coat the paper in these tests so that comparisons of runnability and coated paper properties could be assessed. Monitoring the nip exit of the metering size press apparatus assessed misting tendency of each coating test.

TABLE 1

COATING FORMULATION FOR PIGMENTED MSP TRIAL

| Order of Addition | Dosage Parts by weight |
|---|---|
| Dispex N-40 Dispersant | 0.1 |
| Hydrasperse #2 kaolin clay | 50 |
| Hydracarb 90 calcium carbonate | 50 |
| Nopcote C104 Calcium stearate | 0.5 |
| Dow 692 SBR latex | 10 |
| Tinopal PT Optical brightener agent | 0.5 |
| Adjust pH to 9.0 | |
| Solids target 61.2 ± 0.2 | |
| Thickener dosage adjusted to produce | |
| 500 ± 100 cps Brookfield RVT @ 100 RPM | |

TABLE 2

SUMMARY OF PIGMENTED METERING SIZE PRESS TRIAL TESTS

| Test Condition | Rheological Modifier | Dosage (per 100 # of pigment) | Coating Viscosity, % Solids | Metering Size Press Runnability Observed |
|---|---|---|---|---|
| 1 | Ambergum ® 770 low Molecular weight CMC | 0.43 active parts | 470 cps, 61.2% | Little misting on lowest coater speed, but misting increased to severe at 4500 foot/minute. |
| 2 | AQU D-3556, 30% active High Molecular weight CMC | 0.62 wet parts | 528 cps, 61.5% | Severe misting at highest coater speed. |
| 3 | Admiral ® FPS 3089, 25% active Hydroxyethylcellulose | 0.54 active parts | 560 cps, 61.1% | Very low misting at all metering size press speeds |

TABLE 3

SUMMARY OF PIGMENTED METERING SIZE PRESS TRIAL COATED PAPER PHYSICAL TEST RESULTS @ 4500 FPM COATER SPEED

| Test Condition | Rheological Modifier | Average opacity | K + N Ink Absorption | Average Brightness |
|---|---|---|---|---|
| 1 | Ambergum ® 770 low Molecular weight CMC | 93.1 | 18.2 | 88.1 |
| 2 | AQU D-3556, 30% active High Molecular weight CMC | 93.5 | 18.7 | 87.9 |
| 3 | Admiral ® FPS 3089, 25% active Hydroxyethylcellulose | 93.8 | 19.2 | 88.3 |

The paper coatings tested and runnability results are described in Tables 1 and 2. Misting panel results showing the effects results of incorporating Admiral 3089FS Fluidized Polymer Suspension, a 25% active suspension of hydroxyethylcellulose, into the pigmented metering size press process as compared to CMC are shown in FIGS. 1 and 2. In this test method, a black panel was placed near the web exit of the pigmented metering size press for a standard length of time. The coating misting tendency was indicated by the quantity of white coating spots that deposit on the test panel. It was clearly shown that the white coating deposits of the HEC coating were much lower than was observed with CMC coating. This beneficial effect of the HEC incorporation was particularly pronounced at higher coater speeds.

It was observed during this series of trials that the paper coating containing hydroxyethylcellulose (ADMIRAL® 3089FS fluid polymer suspension (FPS)) desirably exhibited the least/best misting of any coatings tested in the metering size press at high speeds. In subsequent physical testing of the coated paper from these trials, it was then also found that the coated paper made with ADMIRAL® 3089 FS FPS gave one of the highest opacity, Tappi brightness, and higher K&N Ink absorption, when compared with carboxymethylcellulose (CMC) rheology modifiers in the trial (see Table 3). On visual inspection the coated paper from the ADMIRAL® 3089FS FPS trials also clearly exhibited the most complete fiber coverage, indicative of a bulking effect of this thickener in paper coatings.

It was concluded from this trial comparison that incorporating hydroxyethylcellulose into the pigmented metering size press trial process produces unexpected valuable runnability performance. It is, therefore, reasonable to expect that nonionic cellulose derivatives that are similar to HEC would also show this same performance, if included into the metering size press application. These latter materials are thought to include water-soluble alkylhydroxyethylcellulose derivatives in general and methylhydroxyethylcellulose MHEC) and ethylhydroxyethylcellulose, (EHEC).

Although the invention has been described with reference to preferred embodiments, it is to be understood that variations and modifications in form and detail thereof may be made without departing from the spirit and scope of the claimed invention. Such variations and modifications are to be considered within the purview and scope of the claims appended hereto.

What is claimed:

1. A process for preparing coated paper comprising a) adding a water-soluble hydroxyalkylcellulose (HAC) having an alkyl moiety of 1 to 4 carbons to a pigmented wet coating formulation in an amount 0.2 to 0.8 parts HAC based on 100 parts of pigment in the coating and b) applying the pigmented wet coating formulation to a moving paper web via roller metering size press.

2. The process of claim 1, wherein the alkyl in the water-soluble hydroxyalkylcellulose has 2 to 3 carbons.

3. The process of claim 1, wherein the water-soluble hydroxyalkylcellulose is hydroxyethylcellulose.

4. The process of claim 1, wherein the pigment is selected from the group consisting of calcium carbonate and kaolin clay.

5. The process of claim 1, wherein the pigmented wet coating formulation contains 100 parts pigment, 10 to 18 parts binder, 0.2 to 0.8 parts HAC, and 20 to 60% solids based on the total weight of the binder and pigment.

6. The process of claim 5, wherein the solids content is 50 to 60% by weight.

7. The process of claim 5, wherein the binder is starch or a latex.

8. The process of claim 7, wherein the latex is a styrene based.

* * * * *